US006286147B1

(12) United States Patent
Ingold

(10) Patent No.: US 6,286,147 B1
(45) Date of Patent: Sep. 11, 2001

(54) STETHOSCOPE SUPPORT

(76) Inventor: James E. Ingold, 3914 Orange Grove Rd., Hillsborough, NC (US) 27278

( * ) Notice: Subject to any disclaimer, the term of this patent is extended or adjusted under 35 U.S.C. 154(b) by 0 days.

(21) Appl. No.: 09/742,728

(22) Filed: Dec. 21, 2000

(51) Int. Cl.[7] ..... A41D 1/04
(52) U.S. Cl. ..... 2/114; 2/115; 2/69
(58) Field of Search ..... 2/69, 114, 115, 2/247–251, 105, 106, 113, 51, 94; 181/131

(56) References Cited

U.S. PATENT DOCUMENTS 742,790 10/1903 Jones .
4,637,075 * 1/1987 Ingrisano et al. ..... 2/94
4,791,681 * 12/1988 Dean ..... 2/106
5,072,456 * 12/1991 Elin ..... 2/94
5,652,961 * 8/1997 Knight-Yurt ..... 2/114
5,692,657 12/1997 Kilo et al. .
6,154,888 * 12/2000 Krohn ..... 2/250

* cited by examiner

*Primary Examiner*—Gloria M. Hale
(74) *Attorney, Agent, or Firm*—Olive & Olive, P.A.

(57) ABSTRACT

The invention provides a stethoscope support assembled onto a garment to be worn by a medical practitioner. The garment is provided with a stethoscope bell holder pocket adjacent one shoulder thereof that is sized to slidingly hold a bell of a stethoscope. A first attachment component is connected to the garment adjacent a second shoulder thereof. A complementary attachment component is connected to the stethoscope in the area of its headpiece. The bell holder pocket and the first attachment component are assembled to the garment at respective positions so that when the stethoscope is worn, the transmission tube does not cause pressure to the neck of the medical practitioner.

9 Claims, 1 Drawing Sheet

STETHOSCOPE SUPPORT

FIELD OF THE INVENTION

The invention disclosed relates to the field of professional medical garments and particularly to such garments adapted for securely supporting a stethoscope when not being used by the garment wearer.

BACKGROUND OF THE INVENTION

A stethoscope is one of the most basic tools used by medical professionals. The stethoscope is so frequently used that it is imperative that the medical practitioner has the stethoscope constantly at hand. Also, it is preferable for the medical practitioner to carry the stethoscope, or other tools, in a manner to keep the hands free for other tasks.

Medical practitioners typically wear either a lab coat or a scrub top during their work shift. A lab coat has a large pocket at the bottom of each front panel and a small pocket at the upper part of one front panel. A scrub top has a small pocket at the upper part of one front panel. The small, upper pocket of either garment is sufficient for small items, such as pens or pencils. The large pockets are large enough, and are frequently used, for carrying a stethoscope.

An alternate and popular mode of carrying a stethoscope is around the neck of the medical practitioner. In the case of a medical practitioner wearing a scrub top, there is no pocket available for holding the stethoscope, thus the stethoscope is generally carried around the neck.

Whether the stethoscope is carried around the neck or in a pocket at the bottom of the garment, when the medical practitioner walks or runs from one place to another, the stethoscope is liable to bounce against the body of the medical practitioner, which is unpleasant. Furthermore, with the stethoscope carried around the neck, the act of walking or running could cause the stethoscope to fall off completely, since nothing is holding it except friction. If the stethoscope is carried in a pocket, it must be extracted from the pocket and the headpiece and bell properly oriented for wearing, consuming possibly critical time. If the stethoscope is carried around the neck of the medical practitioner, the transmission tube will be pulled against the back of the neck by the weight of the bell and the headpiece, causing unwanted pressure on the neck.

Attempts have been made in the past to overcome the problems described above. One such attempt is described in U.S. Pat. No. 3,797,717 for a Stethoscope Receptacle. The '717 patent describes a pocket insert with an outer flap having a slot sized to hold the bell of a stethoscope, with the headpiece being hooked around the neck of the medical practitioner. This attempt leaves the weight of the headpiece causing pressure on the neck of the wearer with the weight of the bell supported on the garment, thus its weight being widely distributed. A second attempt is described in U.S. Pat. No. 5,692,957 for a Stethoscope Holder. The stethoscope holder of the '957 patent utilizes a slot for the stethoscope bell and a hook for the headpiece. The stethoscope holder is attached to a portion of the garment being worn by a medical practitioner. In this second device, the entire weight of the stethoscope is supported at one place on the garment, so that when the medical practitioner walks or runs, the stethoscope will bounce, causing some discomfort. In addition, removing the stethoscope from the holder involves a two-step process, which can be a problem in a crisis situation.

Therefore, it is an object of the present invention to provide a stethoscope support that allows the medical practitioner to remove the stethoscope quickly and easily.

It is another object of the present invention to provide a stethoscope support that avoids pressure of the stethoscope transmission tube against the neck of the medical practitioner.

It is a further object of the present invention to provide a stethoscope support that holds the stethoscope securely so as not to bounce or fall off. These and other objects of the present invention will become apparent through the disclosure of the invention to follow.

SUMMARY OF THE INVENTION

The invention disclosed herein provides a garment to be worn by a medical practitioner that is adapted to support a stethoscope, the stethoscope being adapted to attach to the garment. A top-worn garment for a medical practitioner is provided with a bell holder pocket on a front upper panel adjacent one shoulder thereof. The pocket is sized so as to slidingly receive a bell of a stethoscope. A first attachment component is connected to the garment on a second front upper panel adjacent a second shoulder thereof. A complementary attachment component is connected to the stethoscope in the area of the Y-connector between its transmission tube and its headpiece. The bell holder pocket and the first attachment component are assembled to the garment at respective positions so that when the stethoscope is worn, the transmission tube does not cause pressure to the neck of the medical practitioner.

BRIEF DESCRIPTION OF THE DRAWINGS

In order for the invention to become more clearly understood it will be disclosed in greater detail with reference to the accompanying drawings, in which.

DESCRIPTION OF THE PREFERRED EMBODIMENT

Figure 1:
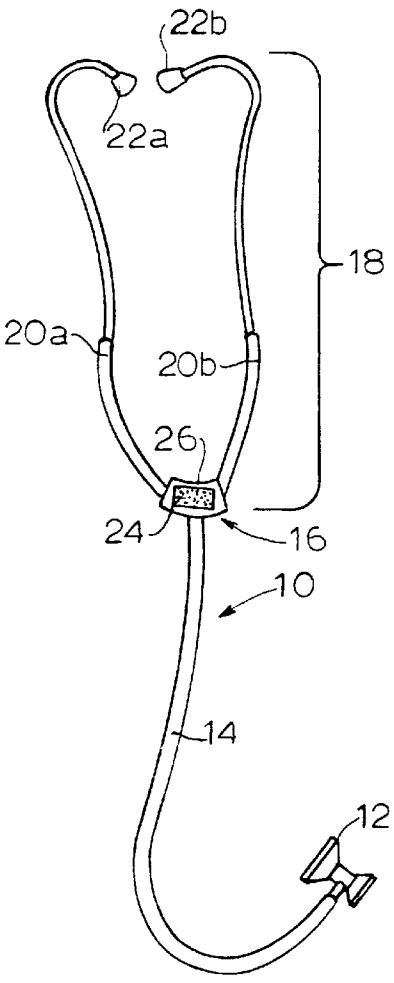
FIG. 1 is a front elevation view of a typical stethoscope that has been adapted according to the invention.

FIG. 1 illustrates a typical stethoscope 10 that is known in the art. Stethoscope 10 has a bell 12 that is connected to a first end of a transmission tube 14, the other end of which terminates in a Y-connector 16. Y-connector 16 also connects to headpiece 18 comprised of left leg 20*a* and right leg 20*b*, each of which terminates with respective earpiece 22*a* and 22*b*. Bell 12 is shown as a "double sided stethoscope head," but could be a bell 12 of a different configuration.

A gripper pad 24 is shown fixedly assembled to stethoscope 10 in the vicinity of headpiece 18, for example at Y-connector 16. One satisfactory means for assembling gripper pad 24 to stethoscope 10 is to first mount support piece 26 to stethoscope 10 at Y-connector 16. Support piece 26 is a saddle-shaped part available from 3M Health Care of St. Paul, Minn. Support piece 26 is substantially locked onto Y-connector 16 by a pair of toothed straps that engage mating sockets (not shown). Support piece 26 has a planar front surface to which gripper pad 24 can be mounted, for example by use of an adhesive. Gripper pad 24 is, in the preferred embodiment, a rigid plate, for example formed of plastics resin, with a fastener component, for example a hook portion of a Velcro® set, affixed thereto.

Figure 2:
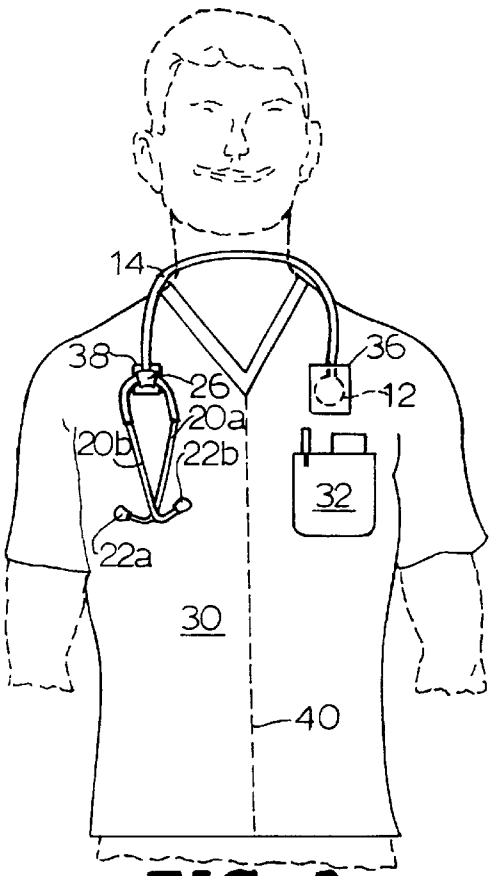
FIG. 2 is a front elevation view of a hospital garment for wear on the upper body with a stethoscope as shown in FIG. 1 assembled thereto, the medical practitioner shown in dashed lines.

Referring now to FIG. 2, stethoscope 10 mounted to garment 30, is shown in front elevation view. Garment 30 in the illustrated example is a shirt garment such as that commonly worn in an operating room. Garment 30 is normally supplied with a pocket 32 for carrying such small items as pens and pencils. Pocket 32 is usually positioned on the front chest area of garment 30 to the left side of vertical centerline 40. A bell holder pocket 36 is provided above pocket 32 on the same side of centerline 40 as pocket 32, according to the preferred embodiment, for minimal interference with access to items stored in pocket 32. Bell holder pocket 36 is formed of a size to slidingly receive bell 12 of stethoscope 10 therein.

An anchor pad 38 is affixed to the front of garment 30 on the right side of centerline 40, according to the preferred embodiment. Anchor pad 38 is a complementary fastener component, for example a loop portion of a Velcro® set that is grippingly compatible with gripper 24 affixed to stethoscope 10. Anchor pad 38 is fastened to garment 30 by any appropriate means, for example, stitching. Any alternate fastener component set able to be engaged and disengaged rapidly, for instance a magnet and a metal plate, would perform satisfactorily according to the invention. Transmission tube 14, connecting from bell 12 to Y-connector 16, passes around the neck of the medical practitioner shown in dashed lines.

Figure 3:
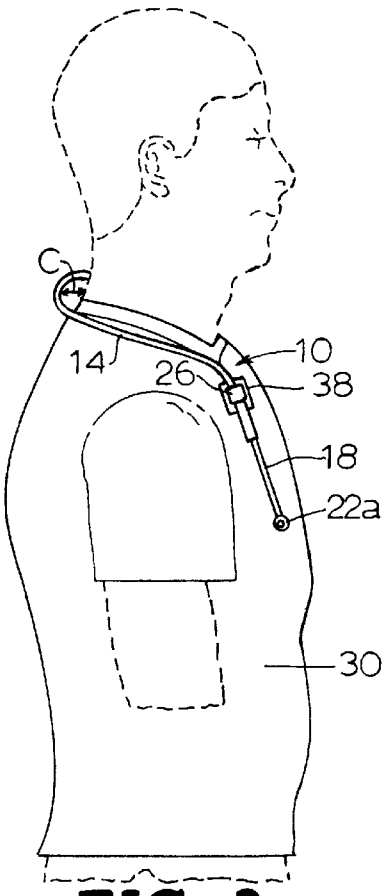
FIG. 3 is a side elevation view of the hospital garment and stethoscope according to FIG. 2.

Referring now to FIG. 3, in which the invention stethoscope support is shown in right side elevation view, the medical practitioner is wearing garment 30 to which stethoscope 10 has been attached. Bell 12 is placed securely into bell pocket 36. Headpiece 18 is removeably held to garment 30 by gripper pad 24 and anchor pad 38. Transmission tube 14 passes around the rear of the neck of the medical practitioner wearer. According to the length of transmission tube 14 and the positioning of bell holder pocket 36 (see FIG. 2) and of anchor pad 38, a clearance C will remain between transmission tube 14 and the rear of the neck of the wearer. As will be readily understood, clearance C can be minimal, so long as transmission tube does not cause uncomfortable pressure on the wearer's neck.

As described above, the invention provides an effective means for supporting a stethoscope on a garment worn by a medical practitioner, allowing quick installing and removal of the stethoscope, preventing pressure on the neck of the wearer by the stethoscope, and preventing bouncing and possible loss as the medical practitioner walks or runs during the work day.

The above detailed description of a preferred embodiment of the invention sets forth the best mode contemplated by the inventor for carrying out the invention at the time of filing this application and is provided by way of example and not as a limitation. Accordingly, various modifications and variations obvious to a person of ordinary skill in the art to which it pertains are deemed to lie within the scope and spirit of the invention as set forth in the following claims.

What is claimed is:

1. A support for a stethoscope having a bell, a transmission tube, and a headpiece, the support comprising:

a) a garment having a vertically oriented centerline and configured to be worn on the upper body, the garment having a bell holder pocket on a first upper front portion thereof at a location that is offset from the centerline in a first lateral direction;

b) an anchor pad assembled to the garment at a location that is offset from the centerline in a second lateral direction on a second upper front portion thereof; and c) a gripper pad fixedly assembled to the stethoscope and configured for being releasably attached to the anchor pad.

2. The stethoscope support as claimed in claim 1, wherein the gripper pad is assembled to the stethoscope at a location adjacent the headpiece of the stethoscope.

3. The stethoscope support as claimed in claim 2, wherein the gripper pad is assembled to the stethoscope at a Y-connector that comprises the juncture of the headpiece with the transmission tube.

4. The stethoscope support as claimed in claim 1 wherein the gripper pad and the anchor pad are matable hook and loop connector components.

5. The stethoscope support as claimed in claim 1 wherein the gripper pad and the anchor pad are mutually magnetically attracted.

6. The stethoscope support as claimed in claim 1 wherein the bell holder pocket is sized for receiving the bell of the stethoscope.

7. The stethoscope support as claimed in claim 1 wherein the bell holder pocket and the anchor pad are positioned on the garment so that when the stethoscope is supported thereby with the transmission tube passing behind the neck of the wearer, the transmission tube does not press against the neck of the wearer.

8. A method for supporting a stethoscope having a bell, a transmission tube, and a headpiece when the stethoscope is not being used so that the stethoscope is accessible and not uncomfortable, comprising:

a) creating a bell holder pocket sized to receive the bell of the stethoscope on the upper front portion of a garment to be worn on the upper body with the pocket positioned laterally offset from a vertical centerline thereof in a first lateral direction;

b) assembling an anchor pad to the garment at a position offset from the centerline in a second lateral direction; and c) assembling to the stethoscope a gripper pad configured for being releasably attached to the anchor pad.

9. The method for supporting a stethoscope as claimed in claim 8, further comprising the step of positioning the bell holder pocket and the anchor pad on the garment at respective positions such that when the stethoscope is worn, the transmission tube does not press on the neck of the wearer.

* * * * *